US010989193B2

(12) United States Patent
Guntermann et al.

(10) Patent No.: US 10,989,193 B2
(45) Date of Patent: Apr. 27, 2021

(54) SCROLL COMPRESSOR FOR A VEHICLE AIR-CONDITIONING SYSTEM HAVING SPIRAL WALL INCLUDING CONICAL CUT

(71) Applicant: Hanon Systems, Daejeon (KR)

(72) Inventors: Bernd Guntermann, Lennestadt (DE); Kadir Dursun, Hürth (DE); Laura Arriazu, Pulheim (DE)

(73) Assignee: Hanon Systems, Daejeon (KR)

( * ) Notice: Subject to any disclaimer, the term of this patent is extended or adjusted under 35 U.S.C. 154(b) by 193 days.

(21) Appl. No.: 15/954,178

(22) Filed: Apr. 16, 2018

(65) Prior Publication Data

US 2018/0335031 A1 Nov. 22, 2018

(30) Foreign Application Priority Data

May 17, 2017 (DE) ..... 102017110759.2

(51) Int. Cl.
*F04C 18/02* (2006.01)

(52) U.S. Cl.
CPC ..... *F04C 18/0284* (2013.01); *F04C 18/0215* (2013.01); *F04C 18/0269* (2013.01); *F04C 2230/10* (2013.01); *F04C 2250/201* (2013.01)

(58) Field of Classification Search
CPC ..... F04C 18/0215; F04C 18/0261; F04C 18/0269; F04C 2210/26; F04C 2230/10;
(Continued)

(56) References Cited

U.S. PATENT DOCUMENTS 4,558,997 A 12/1985 Sakata et al.
4,781,549 A * 11/1988 Caillat ..... F01C 1/0246 418/150

(Continued)

FOREIGN PATENT DOCUMENTS

DE 4208171 C2 9/1996
DE 69601762 T2 9/1999

(Continued)

OTHER PUBLICATIONS

Office Action dated Mar. 3, 2019 by Korean Patent Office in a counterpart patent application No. 10-2018-0036290.

*Primary Examiner* — Mary Davis
*Assistant Examiner* — Paul W Thiede
(74) *Attorney, Agent, or Firm* — Norton Rose Fulbright US LLP; James R. Crawford

(57) ABSTRACT

A scroll compressor for a motor vehicle air-conditioning system includes a compressor housing, two interleaving spirals within the compressor housing, of which one spiral is stationary and the other spiral is movable eccentrically on a circular orbit, whereby the volume of compression chambers formed between the spirals changes cyclically and refrigerant is suctioned in and compressed; at least one refrigerant outlet port for ejecting the compressed refrigerant in a wall, frontal to the spirals, of the compressor housing in the center of the stationary spiral, wherein in the spiral end region on the inner end of at least one of the two spirals the concave side of the spiral wall is provided with a cut that has the form of a cone segment with concave curvature, decreasing from the upper end in the direction toward the lower end of the spiral wall.

14 Claims, 4 Drawing Sheets

(58) Field of Classification Search
CPC ..... F04C 2230/20; F04C 2240/20; F04C 2250/201; F04C 2250/30; F04C 18/0284; F04C 2240/10; F01C 1/04; F01C 21/04; F01C 21/08
USPC ... 418/55.2, 15, 55.1, 55.3, 55.4, 55.5, 55.6, 418/97, 150, 182; 417/410.1; 384/29, 384/95, 129, 255, 276, 290, 296, 447; 428/403
See application file for complete search history.

(56) References Cited

U.S. PATENT DOCUMENTS

| | | | | |
|---|---|---|---|---|
| 5,037,279 | A | 8/1991 | Suefuji et al. | |
| 5,242,283 | A * | 9/1993 | Mori | F04C 18/0261 418/183 |
| 5,421,707 | A * | 6/1995 | Daniels | F04C 18/0284 418/142 |
| 5,520,525 | A * | 5/1996 | Mizuno | F04C 18/0269 418/55.2 |
| 5,765,999 | A | 6/1998 | Ito et al. | |
| 5,944,500 | A * | 8/1999 | Iizuka | F04C 18/0246 418/55.2 |
| 6,213,741 | B1 * | 4/2001 | Mori | F04C 18/0269 418/55.2 |
| 2006/0269432 | A1 | 11/2006 | Lifson | |

FOREIGN PATENT DOCUMENTS

| | | |
|---|---|---|
| JP | H05-202864 | 8/1993 |
| JP | 2001221177 A | 8/2001 |
| JP | 2007-002736 | 1/2007 |
| JP | 2007-002736 A | 1/2007 |
| KR | 19990183505 | 5/1999 |

* cited by examiner

SCROLL COMPRESSOR FOR A VEHICLE AIR-CONDITIONING SYSTEM HAVING SPIRAL WALL INCLUDING CONICAL CUT

CROSS REFERENCE TO RELATED APPLICATIONS

This application claims priority from German Patent Application No. 102017110759.2 filed May 17, 2017, which is hereby incorporated by reference in its entirety.

FIELD OF THE INVENTION

The invention relates to a scroll compressor for a motor vehicle air-conditioning system, comprising two interleaving spirals one of which having a truncation cut at its inner end.

BACKGROUND OF THE INVENTION

The term scroll compressor is the customary technical term for a compressor type that is also known as gear worms compressor or spiral compressor. A scroll compressor operates according to the principle of positive displacement. As a rule, it consists of two interleaving spirals of which one is stationary and the other is moved eccentrically on a circular orbit. The spirals herein maintain minimal spacing from one another and with each orbiting gyration form two increasingly smaller compression chambers. The gas to be pumped is hereby externally suctioned in, compressed in the compression chambers within the scroll compressor and expelled via a port in the spiral center.

Currently used designs for the inner end segment of at least one of the two spirals utilizes a vertical cut to connect the two scroll compartments with one another. For such a cut, denoted in the following as prismatic cut, an elaborate and complex fabrication process is necessary.

JP 2007-002736 describes a scroll compressor in which the vibrations and noise are intended to be reduced through stable operation. In this scroll compressor a recess is developed in the surface of the inner wall of a side wall of a fixed spiral that is opposed by an orbiting spiral. A similar recess Is developed on a side wall of the orbiting spiral. Through the gyration of the orbiting spiral relative to the fixed spiral a first and a second middle compression chamber, that are adjacent to an end compressor chamber, developed between the fixed spiral and the orbiting spiral, are in communication with one another via the recesses.

The disadvantages of the known prior art reside therein that in the region of the cut there is contact between the fixed and the moving spiral body. This leads to redundancy of the contact system. The design causes stress concentrations that occur at the inner corner of the cuts. The strain on the thinnest segment of the wall causes deformations of the wall, which can lead directly to a fracture or it can augment the problems caused by the contact of the two spirals, such as for example increased temperature, wear and friction. A further difficulty caused by corresponding designs of prior art is the significant decrease of the wall thickness at the end segment and a reduction entailed therein of the size of the end area for discharging the small volumes of the refrigerant after the compression. The suboptimal refrigerant flow in the direction toward the refrigerant outlet port of the scroll compressor, which is caused by the currently used geometry of the cut at the end region of at least one of the spirals, represents a further problem since a less optimal refrigerant flow leads to an increased torque and increased compressive force (overpressure) on the wall of the cut in the end region and therein to an unbalanced forces/torque system in the middle of the spiral.

The problem underlying the invention comprises providing a stable and cost-effectively generatable form of the end segment of at least one of the spirals of a scroll compressor that is suitable for reducing the overpressure that occurs when ejecting the compressed refrigerant.

SUMMARY OF THE INVENTION

The problem of the invention is resolved through a scroll compressor with the characteristics described herein The scroll compressor according to the invention for a motor vehicle air-conditioning system comprises

- a compressor housing;
- two interleaving spirals within the compressor housing, of which one spiral is stationary and the other is eccentrically movable on a circular orbit whereby the volume of compression chambers forming between the spirals changes cyclically and refrigerant is suctioned in and compressed;
- at least one refrigerant outlet port for ejecting the compressed refrigerant in a wall frontal facing the spiral of the compressor housing in the center of the stationary spiral;

wherein in a spiral end region on the inner end of at least one of the two spirals the concave side of the spiral wall is provided with a cut that has the form of a cone segment with concave curvature, which segment reduces in size from the upper end in the direction toward the lower end of the spiral wall.

According to the concept, in the spiral end region, i.e. in the proximity of the inner end of at least one of the spirals, the stationary and/or the orbiting spiral, a conical cut is developed. The conical cut connects the inner compression chamber, formed by the opposing spiral regions of the stationary and the orbiting spiral, more easily with the main refrigerant outlet port than would be the case without the cut at the end of the spiral. This supports the gas in being enabled to flow out of the main refrigerant outlet port precisely at the point at which the compression chamber reaches ejection pressure such that no generation of undesirable overpressure can occur. The conical cut leads to the condition that in a certain rotational drive angle range of the compressor no contact exists between the two spirals. This improves the leak-tightness of the outer low pressure chambers. In addition, contact forces between the spirals are thereby gradually shifted to the outer windings where the curvature is lesser and the radius greater. This reduces the wear and tear considerably.

The conical development of the cut consequently leads to a decrease of the overpressure at the end of the compression and to an improvement in the sealing of the compression chambers with a noticeable reduction of leakage of the refrigerant. At the operating points at which such is necessary, the overpressure can be decreased without losing too much volumetric efficiency. An enhancement of the isentropic efficiency is thereby achieved.

According to an advantageous embodiment of the invention, the conically shaped cut extends over the entire height of the spiral wall, i.e. from the upper end to the lower end of the spiral wall. The volume of the cut is herein distributed from the upper end to the lower end of the spiral wall corresponding to the oblique shape. The conical shape brings about a smooth characteristic of the cross sectional course with which the connection of two pressure chambers is released. Due to the conical shape of the cut an oblique edge is preferably obtained that extends over the entire height of the spiral wall and improves the transition of the different contact points between the spiral walls. It is especially advantageous if the cut is implemented in such manner and the oblique edge is inclined at such angle that the thickness of the spiral wall at its lower end in the proximity of the cut is the same as in the regions of the spiral outside of the cut, i.e. that the wall thickness at the lower end of the spiral is maintained. The mechanical strength, rigidity and loading resistance of the spiral in the spiral end region is not negatively affected. Since the cut extends over the entire height from the upper to the lower end of the spiral, in the generation of the conical cut, less material has to be cut away in the longitudinal direction of the spiral at a volume that is unchanged compared to a prismatic cut according prior art.

According to an especially preferred embodiment of the invention, the cut is conically shaped such that the oblique edge at the inner end of the spiral converges with a second oblique edge of the cut extending from the upper end of the spiral wall down to the lower end, in an angular point at the corner of the inner end at the lower end of the spiral.

The stationary spiral and/or the orbiting spiral can be provided with the cut. The conical cut of the spiral end region generates an optimized refrigerant flow in the direction toward the spiral outlet for the case that the cut is located at the end of the stationary spiral as well as also for the case that the cut is implemented at the end of the orbiting spiral.

The essential advantages of the invention reside in an improvement of the efficiency and machine acoustics. Moreover, the contour of the cut can also be generated with relatively low expenditures. For example, the contour can also be already worked directly into the unfinished casting or forged part which obviates any further working of the unmachined part and the orthogonal cutting expenditures, in comparison to the production of a prismatic cut, do not apply. However, the cut can also be generated using milling with a conical milling tool.

BRIEF DESCRIPTION OF THE DRAWING

Further details, characteristics and advantages of implementations of the invention are evident in the following description of embodiment examples with reference to the associated drawing. Therein depict.

DETAILED DESCRIPTION

Figure 1B:
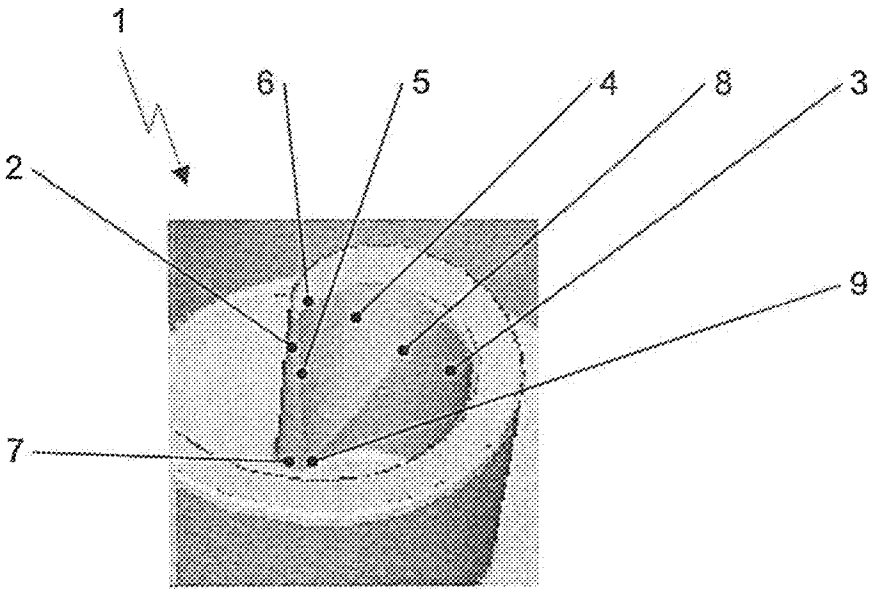
FIG. 1B: a spiral of a scroll compressor with an obliquely cut form of the spiral end region.
Figure 1A:
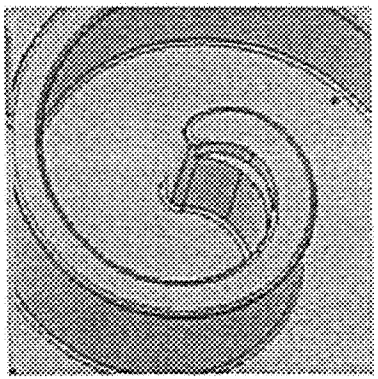
PRIOR ART Fig. 1A
FIG. 1A: a prior art spiral of a scroll compressor with a prismatic cut form of the spiral end region.

FIG. 1A shows a spiral of a scroll compressor with a prismatically cut form of the spiral end region according to prior art. In its spiral end region the depicted spiral comprises a vertical cut denoted as prismatic. The wall thickness in the spiral end region is significantly less than in the region of the remaining spiral.

FIG. 1B shows an embodiment example according to the invention of a spiral 1 of a scroll compressor, stated more precisely of its spiral end region. In the spiral end region at the inner end 2 of spiral 1 the concave side 3 of the spiral wall is provided with a cut 4 which has the generated shell form of a concavely curved surface of a cone segment. Through the conical form of the cut 4 an oblique edge 5 results on the inner end 2 of spiral 1, wherein the oblique edge 5 extends over the entire height of the spiral wall. Consequently, the volume of the cut 4, in accordance with its oblique shape, is distributed from its upper end 6 to the lower end 7 of the spiral wall. The cut 4 is herein developed such and, in particular, the oblique edge 5 is inclined at such angle that at the lower end 7 of the spiral 1 the wall thickness of the spiral is maintained. Stated differently, the thickness of the spiral wall at its lower end 7, even in the region of cut 4, is of the same magnitude as in regions of spiral 1 outside of the cut 4. The mechanical strength, rigidity and loading resistance of the spiral is not negatively affected in the region of the cut 4. Since the cut extends from the upper end 6 to the lower end 7 of the spiral, in the generation of the conical cut 4, less material needs to be cut off in the longitudinal direction of the spiral 1 at a volume of the material cut from the spiral that is unchanged compared to a prismatic cut of prior art.

As FIG. 1B shows, the cut 4 is formed conically such that the oblique edge 5 and a second oblique edge 8 of cut 4, that extends from the upper end 6 of the spiral wall down to the lower end 7, converge in an angular point 9 on the corner of the inner end 2 at the lower end 7 of the spiral 1.

Figure 2A:
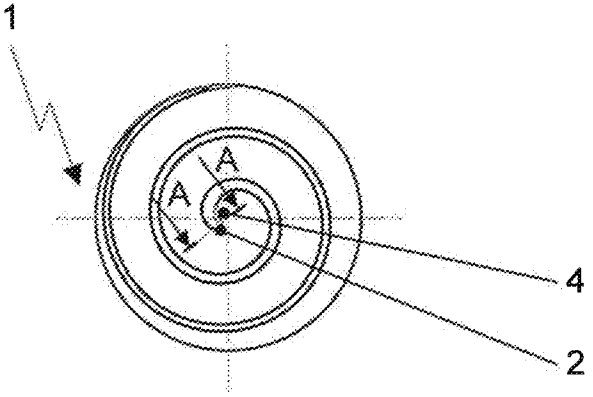
FIG. 2A: a top view onto a spiral of a scroll compressor with an obliquely cut form of the spiral end region.
Figure 2B:
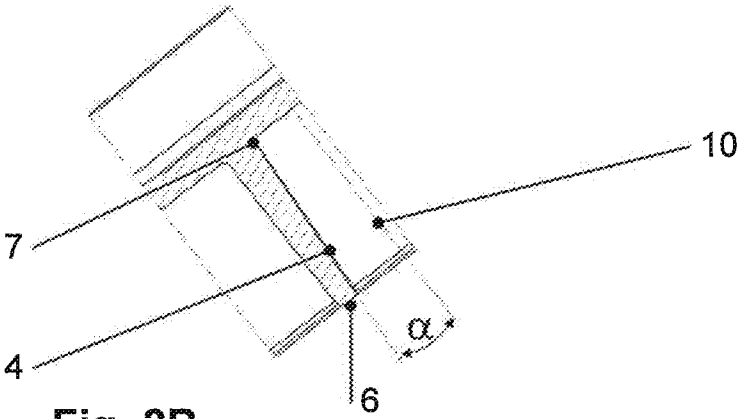
FIG. 2B: a cross section of the spiral along a sectional plane in the spiral end region.

FIG. 2A shows a top view onto a spiral 1 of a scroll compressor with a conical cut 4. FIG. 2A shows at the same time the sectional plane A for the cross sectional representation following in FIG. 2B, which extends through the cut 4 in the spiral end region at the inner end 2 of spiral 1. The cross section in FIG. 2B includes the spiral wall starting from the bottom at the lower end 7 up to the upper end 6. The cross sectional depiction shows in particular the oblique orientation of cut 4 at an angle $\alpha$ with respect to an axis 10 that extends parallel to the non-cut spiral wall.

Figure 2C:
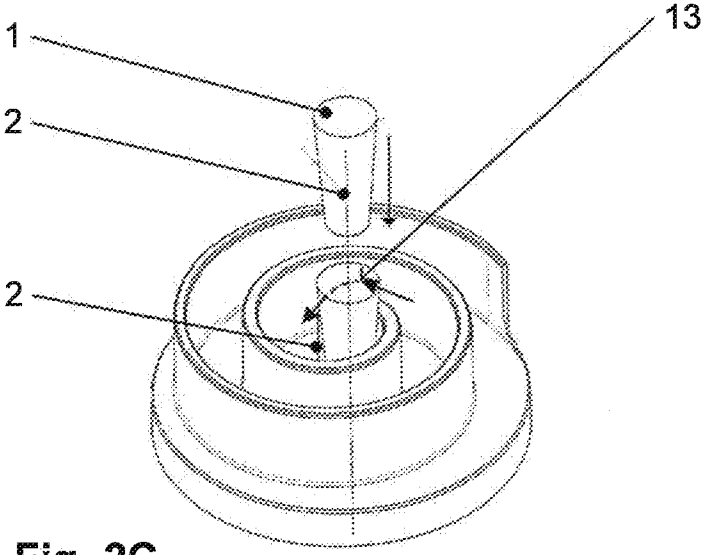
FIG. 2C: a schematic representation of the generation of the oblique cut of the spiral end region by means of a conical milling tool.
Figure 2D:
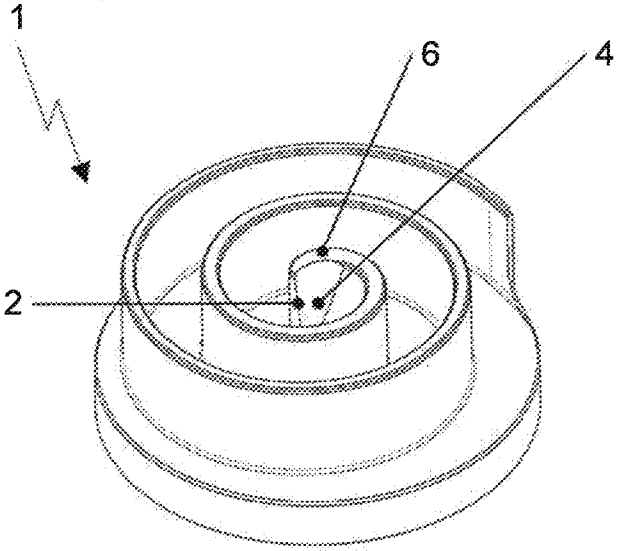
FIG. 2D: a perspective representation of the spiral with the cut generated by means of the conical milling tool in the spiral end region.

In FIG. 2C the manner in which the conical cut 4 at the inner end 2 of spiral 1 can be generated is shown schematically. The concave side of the spiral wall in the spiral end region, i.e. at the inner end 2 of spiral 1, is worked with a conical milling tool 11 whose diameter tapers downwardly. The conical milling tool 11 is set into the spiral center in the direction of the tool axis 12 (cone axis) and, with a portion of its conically convex circumferential surface, contacts the spiral end region along its tool path 13 which is sketched out in FIG. 2C in a dashed line. The movement of the convex conical milling tool 11 along the tool path 13 leads to a corresponding concave cut 4 on the inside 3 of the spiral wall at the inner end 2 of spiral 1, as is shown in FIG. 2D. This means that this cut 4 has the shape of a cone segment with concave curvature which decreases from the upper end 6 down to the, not shown, lower end of the spiral wall.

Figure 3:
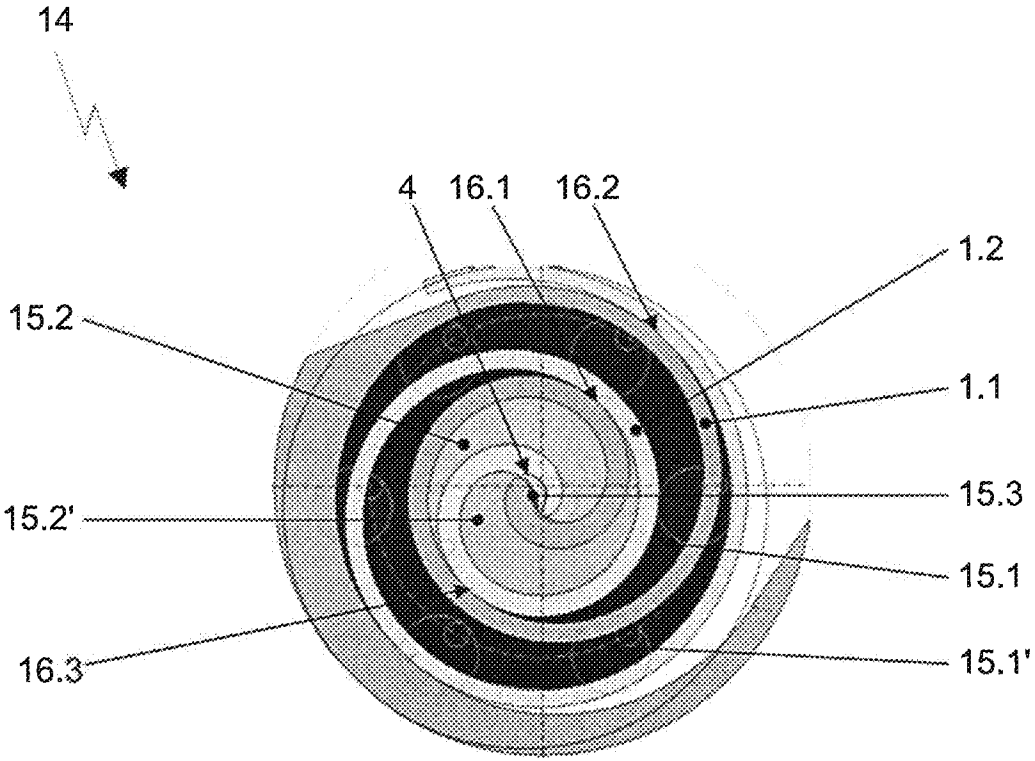
FIG. 3: a schematic representation of a scroll compressor with a conically cut spiral end of the orbiting spiral.

In FIG. 3 is shown schematically a scroll compressor 14 comprising interleaving spirals 1.1; 1.2, of which one spiral 1.1 is stationary and the other spiral 1.2 is movable eccentrically on a circular orbit, whereby the volume of compression chambers 15.1, 15.1'; 15.2, 15.2'; 15.3 formed between the spirals 1.1; 1.2 changes cyclically and refrigerant is suctioned in and compressed. FIG. 3 shows herein the scroll compressor 14 at a certain rotational angle of the orbiting spiral 1.2, in which the two spirals 1.1; 1.2 are at several contact points 16.1, 16.2; 16.3 in the radial direction in contact with one another. Although the spiral end regions of both spirals 1.1; 1.2 are closely opposite to one another, due to the conical cut 4 that is developed over the entire height of the spiral wall, there is no radial contact between the two spirals 1.1; 1.2 at this rotational angle. Since therewith one of the radial contacts is eliminated, the redundancy is reduced and consequently the leak-tightness of the outer compression chambers 15.1, 15.1; 15.2, 15.2' at lower pressures is improved. Moreover, contact forces between the spirals 1.1; 1.2 are thereby gradually shifted to the outer windings where the curvature is lesser and the radius greater. This reduces the wear considerably.

Figure 4:
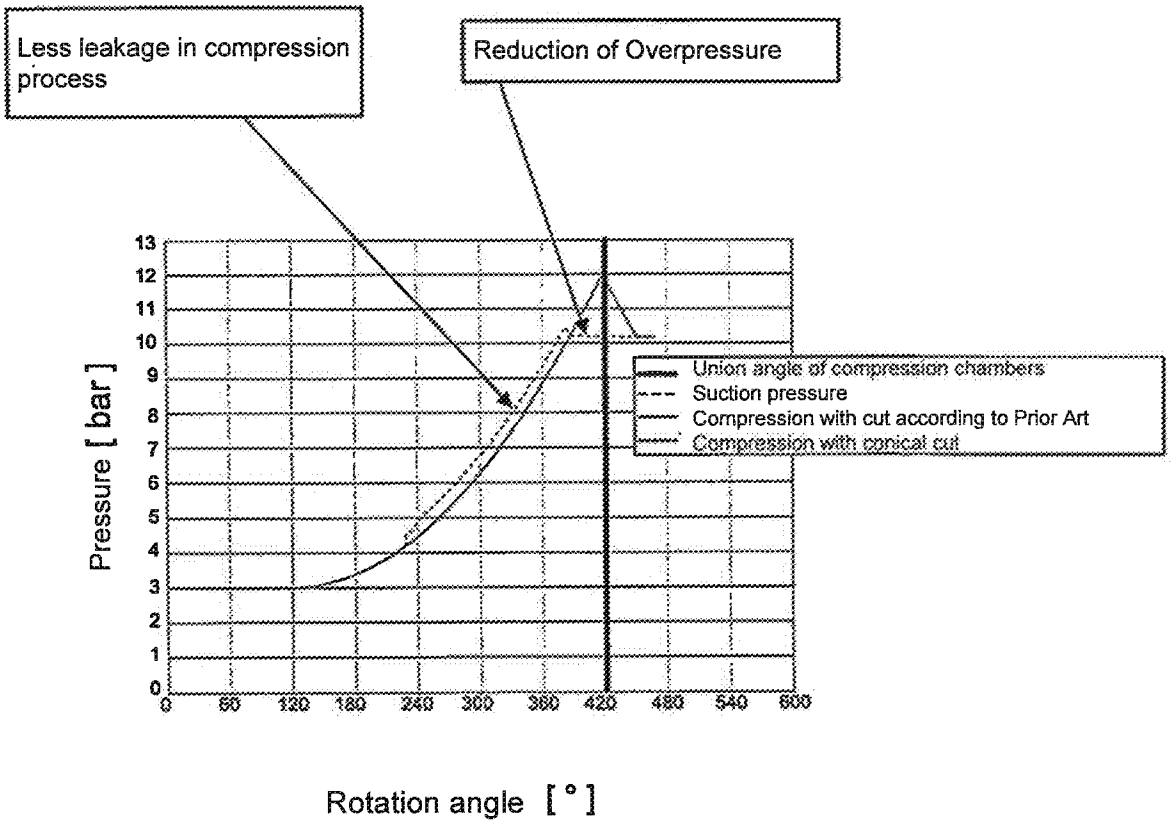
FIG. 4: a pressure profile diagram with comparison curves.

FIG. 4 shows a pressure profile diagram in which the pressure course in a compressor as a function of the rotational angle when applying a cut developed according to prior art at an inner spiral end is compared to the pressure course in a compressor when developing a conical cut on one of the spiral ends. In the pressure profile of the compression curve is evident in a scroll compressor with a conical cut on one of the inner spiral ends a markedly lower leakage during the compression process in comparison to a scroll compressor in which an inner spiral end of one of the two spirals has a prismatic cut. A shoulder in the curve also shows clearly the decrease of the overpressure in the rotational angle region about the union angle, i.e. about the angle in which the complementary compression chambers 15.2; 15.2', cf. FIG. 3, combine to form a central compression chamber.

LIST OF REFERENCE SYMBOLS

1 Spiral
1.1 Stationary spiral
1.2 Orbiting spiral
2 Inner end of spirals 1.1 or 1.2
3 Concave side of spiral wall
4 Cut
5 Oblique edge
6 Upper end of spiral wall
7 Lower end of spiral wall
8 Second oblique edge
9 Angular point
10 Axis (parallel to the non-cut spiral wall)
11 Conical milling tool
12 Tool axis
13 Tool path
14 Scroll compressor
15.1 Compression chamber
15.1' Compression chamber
15.2 Compression chamber
15.2' Compression chamber
15.3 Compression chamber
16.1 Contact point (radial contact)
16.2 Contact point (radial contact)
16.3 Contact point (radial contact)
α Orientation angle of cut with respect to axis 10
A Sectional plane

The invention claimed is:

1. A scroll compressor for a motor vehicle air-conditioning system, comprising:

a compressor housing, two interleaving spirals within the compressor housing, of which one spiral is stationary and the other spiral is movable eccentrically on a circular orbit, whereby the volume of compression chambers formed between the two interleaving spirals changes cyclically and refrigerant is suctioned in and compressed;

at least one refrigerant outlet port for ejecting the compressed refrigerant in a wall, frontal to the two interleaving spirals, of the compressor housing in the center of the stationary spiral, wherein a spiral wall of the two interleaving spirals includes an inner circumferential surface located radially inside with respect to a longitudinal central axis of the spiral wall, and an outer circumferential surface located radially outward with respect to the longitudinal central axis of the spiral wall, a tip inner end having a surface that interconnects the inner circumferential surface and the outer circumferential surface, wherein in a spiral end region that includes the tip inner end of at least one of the two interleaving spirals the inner circumferential surface of the spiral wall is provided with a conical cut formed of a cone segment with a concave curvature, decreasing from an upper end of the spiral wall in a direction toward a lower end of the spiral wall, wherein the conical cut includes a first oblique edge at least partially positioned along the surface of the tip inner end and a second oblique edge that is spaced apart from the surface of the tip inner end, wherein the first oblique edge of at least one of the two interleaving spirals converges towards the lower end of the spiral wall with the second oblique edge of the conical cut that extends from an upper end of the spiral wall down to the lower end, the first oblique edge and the second oblique edge converging at an angular point on a corner of the tip inner end at the lower end, wherein an absolute value of a slope of the first oblique edge positioned at the tip inner end has a greater absolute slope value than an absolute slope value of the second oblique edge.

2. A scroll compressor as in claim 1, wherein the conical cut is developed such and the first oblique edge is inclined at such an angle that the thickness of the spiral wall at the lower end in a region of the conical cut is the same as in regions of the spiral wall outside of the conical cut.

3. A scroll compressor as in claim 2, wherein the stationary spiral is provided with the conical cut.

4. A scroll compressor as in claim 2, wherein the moveable spiral is provided with the conical cut.

5. A scroll compressor as in claim 2, wherein the conical cut has already been worked in during the production of the unmachined part of the moveable spiral.

6. A scroll compressor as in claim 1, wherein the stationary spiral is provided with the conical cut.

7. A scroll compressor as in claim 1, wherein the moveable spiral is provided with the conical cut.

8. A scroll compressor as in claim 1, wherein the conical cut has already been worked in during production of the unmachined part of the moveable spiral.

9. A scroll compressor as in claim 1, wherein the conical cut has been generated by milling using a conical milling tool.

10. A scroll compressor as in claim 1, wherein the conically formed cut extends over the entire height of the spiral wall.

11. A scroll compressor as in claim 10, wherein the stationary spiral is provided with the conical cut.

12. A scroll compressor as in claim 10, wherein the moveable spiral is provided with the conical cut.

13. A scroll compressor as in claim 10, wherein the conical cut has already been worked in during the production of the unmachined part of the spiral.

14. A scroll compressor as in claim 10, wherein the conical cut has been generated by milling using a conical milling tool.

* * * * *